US007137268B2

(12) United States Patent
Cook et al.

(10) Patent No.: US 7,137,268 B2
(45) Date of Patent: Nov. 21, 2006

(54) VIBRATION DAMPENING DEVICE

(75) Inventors: Leonard J. Cook, Lewisville, TX (US); Kevin R. Keoppel, Frisco, TX (US); Adam C. Bunnell, Ames, IA (US)

(73) Assignee: Lennox Manufacturing Inc., Marshalltown, IA (US)

( * ) Notice: Subject to any disclaimer, the term of this patent is extended or adjusted under 35 U.S.C. 154(b) by 97 days.

(21) Appl. No.: 10/990,566

(22) Filed: Nov. 17, 2004

(65) Prior Publication Data

US 2006/0101840 A1 May 18, 2006

(51) Int. Cl.
*F25D 19/00* (2006.01)

(52) U.S. Cl. ..... 62/296; 165/69; 181/207; 248/638

(58) Field of Classification Search ..... 62/259.1, 62/260, 295–296; 248/346.01, 638, 678, 248/679; 165/69, 135, 136, 169; 181/205, 181/207, 209, 403; 417/312
See application file for complete search history.

(56) References Cited

U.S. PATENT DOCUMENTS 2,503,456 A * 4/1950 Smith ..... 62/260
2,529,154 A * 11/1950 Hammond et al. ..... 126/620
2,584,573 A * 2/1952 Gay ..... 165/48.2
5,095,716 A * 3/1992 You ..... 62/259.1
6,260,373 B1 * 7/2001 Rockwood ..... 62/295
6,655,648 B1 * 12/2003 Harris ..... 248/678

* cited by examiner

*Primary Examiner*—William E. Tapolcai
(74) *Attorney, Agent, or Firm*—W. Kirk McCord

(57) ABSTRACT

A device is provided for dampening compressor-induced vibration in an air conditioning system of the type having an indoor unit, an outdoor unit and a refrigerant conduit therebetween. The outdoor unit includes a compressor that is operable to circulate a vapor compression refrigerant through the conduit between the indoor and outdoor units. The device is comprised of a support member containing a section of refrigerant line. The support member is located beneath the outdoor unit and the refrigerant line section is interposed in a portion of the refrigerant conduit between said compressor and said indoor unit, such that the refrigerant flowing between the indoor unit and the compressor is routed through the line section in the outdoor unit support member.

25 Claims, 5 Drawing Sheets

VIBRATION DAMPENING DEVICE

TECHNICAL FIELD

This invention relates generally to air conditioning systems wherein a vapor compression refrigerant is used to cool air supplied to an indoor space and in particular to a device for dampening compressor-induced vibration in an air conditioning system.

BACKGROUND ART

In central air conditioning systems typically used in residences, a compressor is operable to circulate a vapor compression refrigerant between an indoor heat exchanger and an outdoor heat exchanger. In recent years, scroll-type compressors for the most part have replaced reciprocating-type compressors in residential air conditioning systems. For cost reasons, such scroll-type compressors typically do not include vibration-dampening springs to isolate the motor and compressor mechanism from the outer housing of the compressor. The refrigerant lines on the suction and discharge sides of the compressor are rigidly attached to this outer housing. Therefore, there is a direct vibration transmission path from the motor and compressor to these refrigerant lines.

In particular the refrigerant line between the indoor heat exchanger and the compressor is susceptible to such vibrations because the line is relatively rigid due its relatively large diameter (e.g., ⅞ inch). In a non-heat pump air conditioning system, where the indoor heat exchanger operates as an evaporator, this refrigerant line corresponds to the compressor suction line, through which vapor refrigerant is drawn from the evaporator to the compressor. The length of this suction line may be about 40 feet, with most of the line being inside the building that is serviced by the air conditioning system. In a heat pump system, this refrigerant line corresponds to the compressor suction line when the system is operated in a cooling mode and to the compressor discharge line when the system is operated in a heating mode.

Such vibrations in the refrigerant line between the compressor and indoor heat exchanger may cause a droning noise that is readily detectable by occupants of the building. This droning noise results when a vibration typically associated with electric motor noise (e.g., approximately 60 Hz and/or one or more harmonic frequencies thereof) is modulated by a low frequency (2 Hz or less) standing wave in the refrigerant line, which varies the intensity of the vibration. The standing wave causes displacement of the refrigerant line, such that contact between the line and a wall, floor or other structural component results in points of noise transmission inside the building.

One solution that has been proposed to inhibit such vibrations is to strap one or more strips of rubber around the refrigerant line, which reduces vibration by adding mass to the line and by frictional damping. This solution typically is used as a "field fix" after the system installer has received a complaint about noise from a customer. The number of rubber strips needed is determined in the field, largely by trial and error.

SUMMARY OF THE INVENTION

In accordance with the present invention, a device is provided for dampening compressor-induced vibration in an air conditioning system of the type having an indoor unit and an outdoor unit. The outdoor unit includes a compressor operable to circulate a vapor compression refrigerant between the indoor and outdoor units via a refrigerant conduit. The device is comprised of a support member located beneath the outdoor unit and a section of refrigerant line housed in the support member. The refrigerant line is interposed in a portion of the refrigerant conduit that extends between the compressor and the indoor unit.

In accordance with an embodiment of the invention, one side of the support member is defined by a relatively flat surface for supporting the outdoor unit and an opposite side of the support member is defined by an array of interconnecting ribs. In accordance with another embodiment of the invention, the section of refrigerant line defines a loop inside the support member. In accordance with yet another embodiment, a resilient material is located between the section of refrigerant line and the support member. The resilient material is preferably in contact with both the refrigerant line and the support member to provide a vibration transmission path from the line to the support member.

In a non-heat pump air conditioning system and in a heat pump system operated in the cooling mode, the portion of the refrigerant conduit between the compressor and the indoor unit preferably corresponds to a compressor suction line through which vapor refrigerant is drawn from the indoor unit when the compressor is in operation. By locating the vibration dampening device in the refrigerant flow path between the compressor and the indoor unit, compressor-induced vibrations are dampened before reaching the interior of the building in which the indoor unit is located.

BEST MODE FOR CARRYING OUT THE INVENTION

The best mode for carrying out the invention will now be described with reference to the accompanying drawings. Like parts are marked in the specification and drawings with the same respective reference numbers. In some instances, proportions may have been exaggerated in order to depict certain features of the invention.

Figure 1:
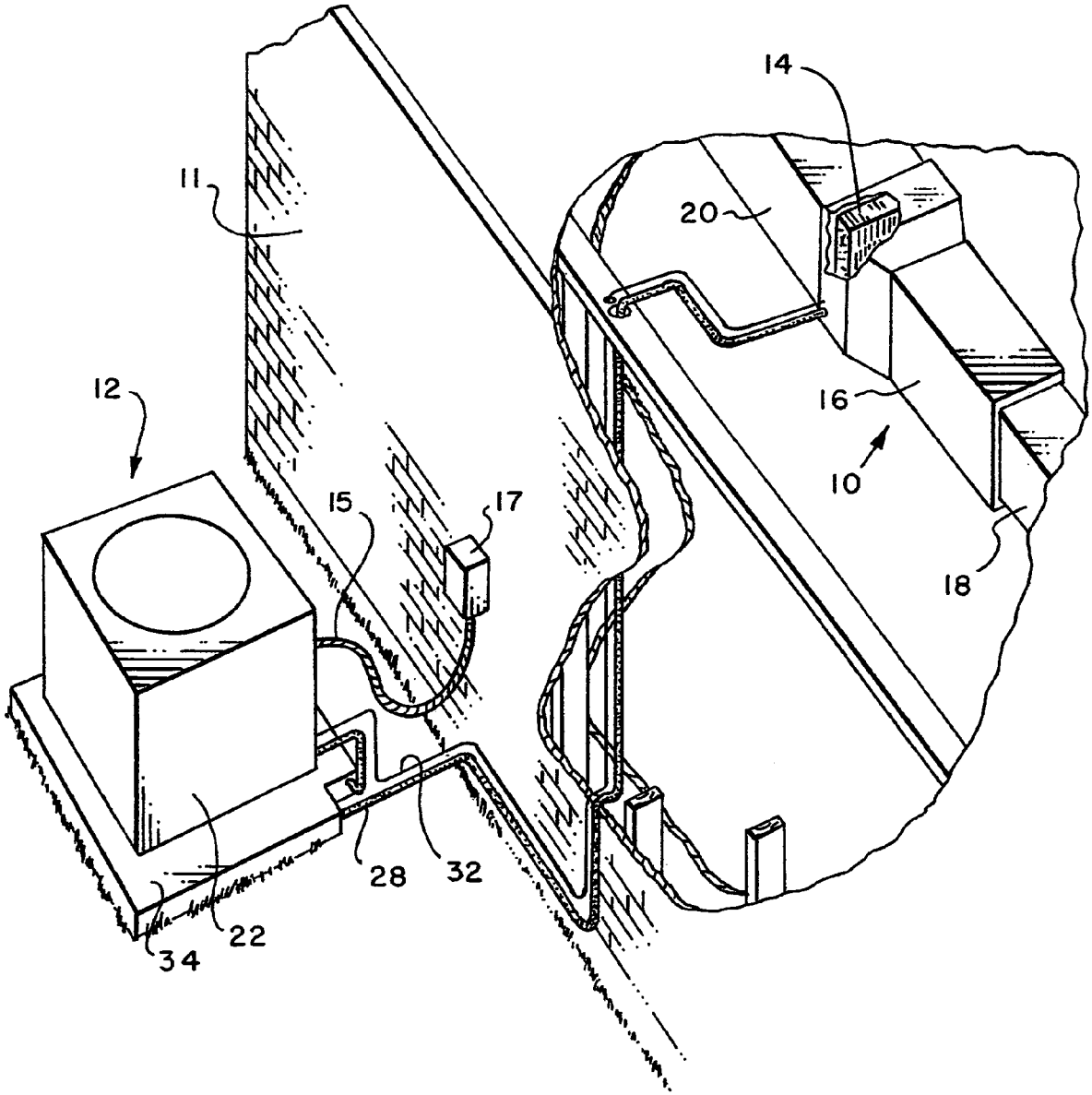
FIG. 1 is a perspective view of an air conditioning system having a vibration dampening device according to one embodiment of the present invention.

Referring now to FIG. 1, a central air conditioning system for a building 11 includes an indoor unit 10 inside of building 11 and an outdoor unit 12 on the outside of building 11. Indoor unit 10 includes a first heat exchanger 14 located inside of an air handler 16, which is coupled between a return air duct 18 and a supply air duct 20. In a non-heat pump air conditioning system, indoor heat exchanger 14 is operable to cool air being supplied to an indoor space through supply duct 20. In a heat pump system, heat exchanger 14 is operable to cool the supply air when the system is operated in a cooling mode and to heat the supply air when the system is operated in a heating mode. A power cable 15 couples outdoor unit 12 to a power source 17, whereby electrical power is supplied to outdoor unit 12.

Figure 2:
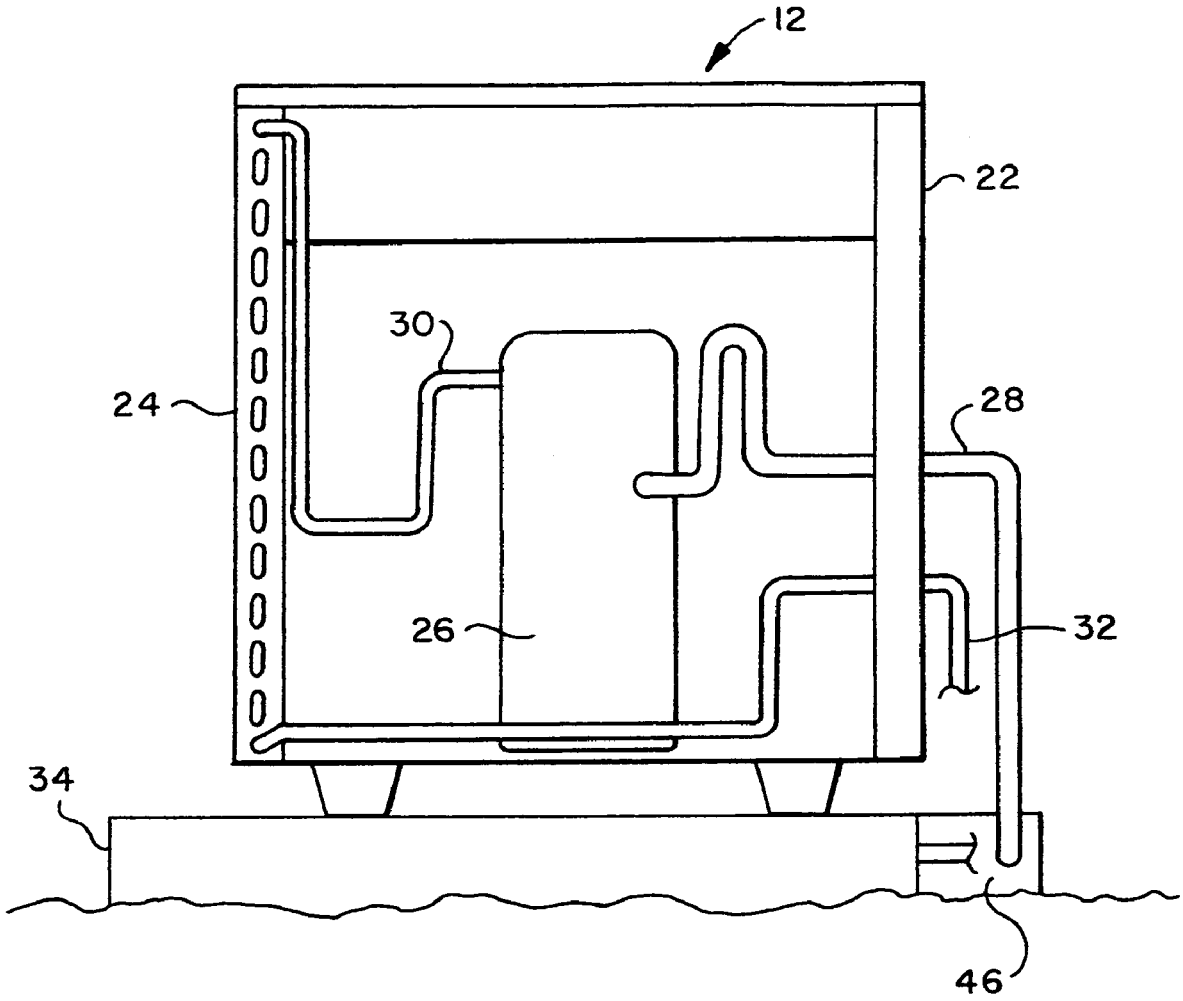
FIG. 2 is an interior elevation view of an outdoor portion of the air conditioning system of FIG. 1.
Figure 3:
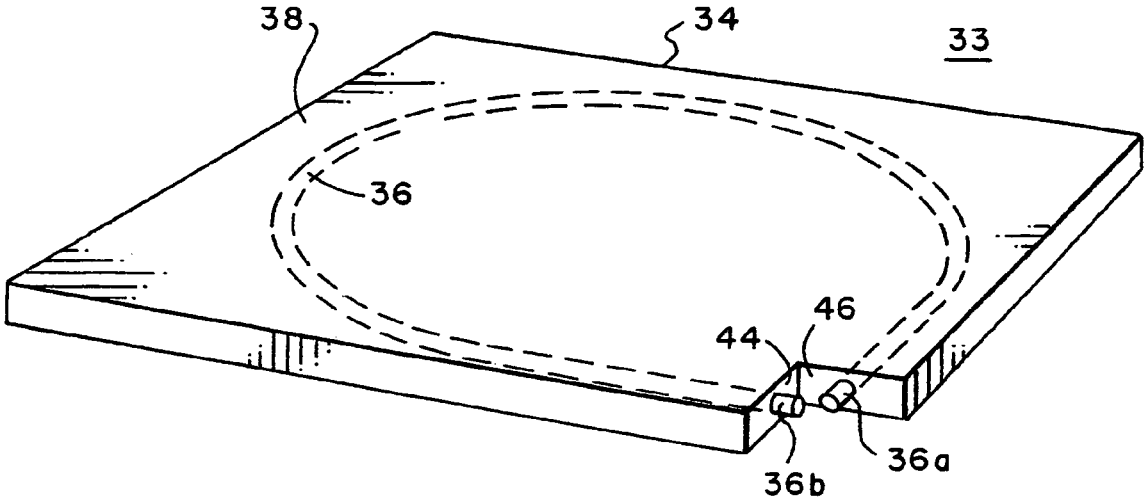
FIG. 3 is a perspective view of the vibration dampening device included in the air conditioning system of FIG. 1.
Figure 4:
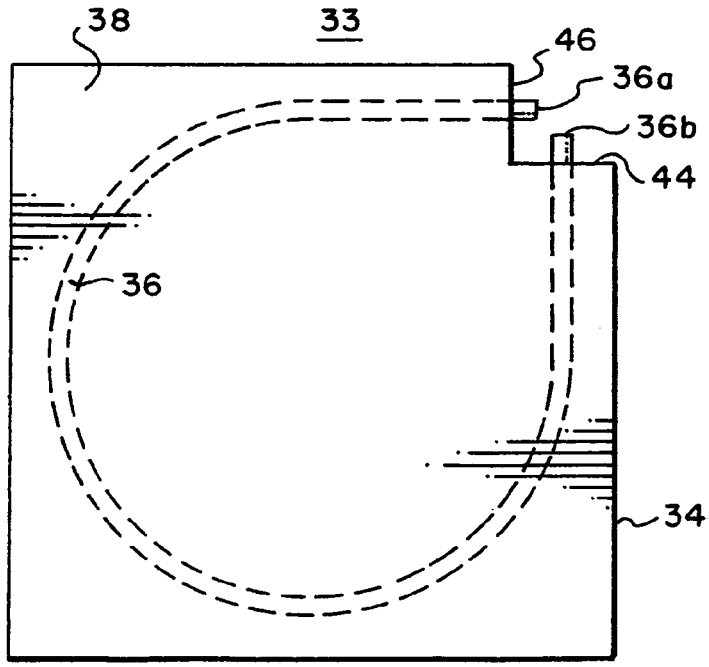
FIG. 4 is a top plan view of the vibration dampening device of FIG. 3.
Figure 5:
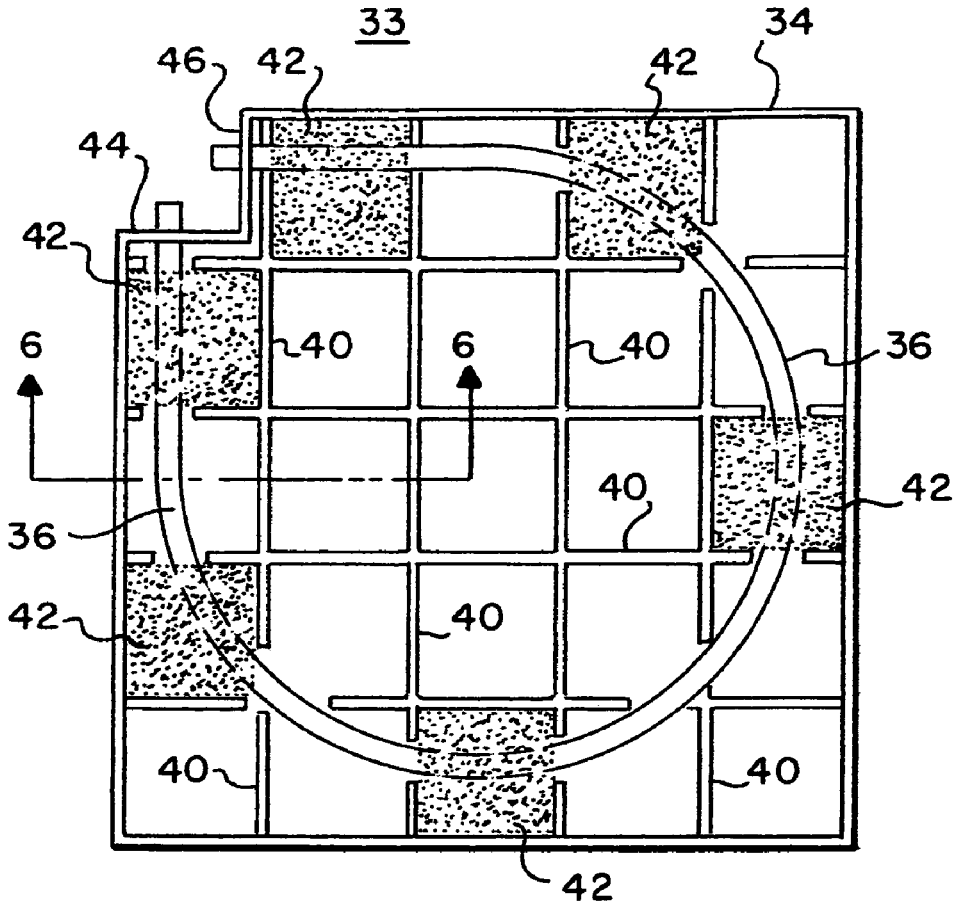
FIG. 5 is a bottom plan view of the vibration dampening device of FIG. 3.
Figure 6:
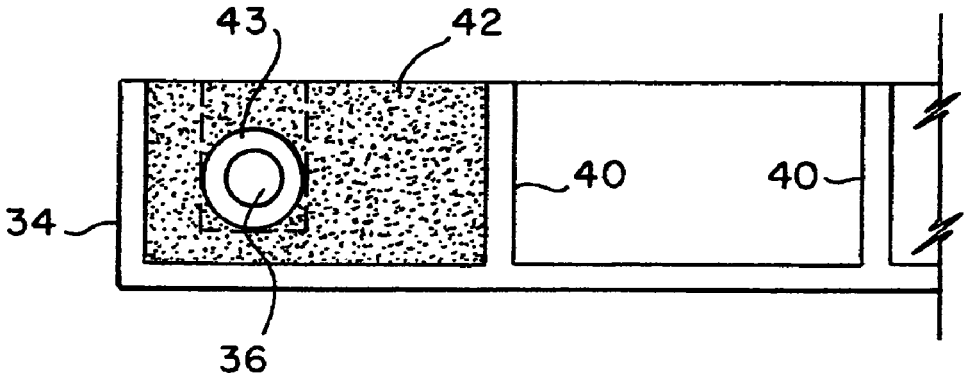
FIG. 6 is a sectional view, taken along the line 6—6 of FIG. 5.
Figure 7:
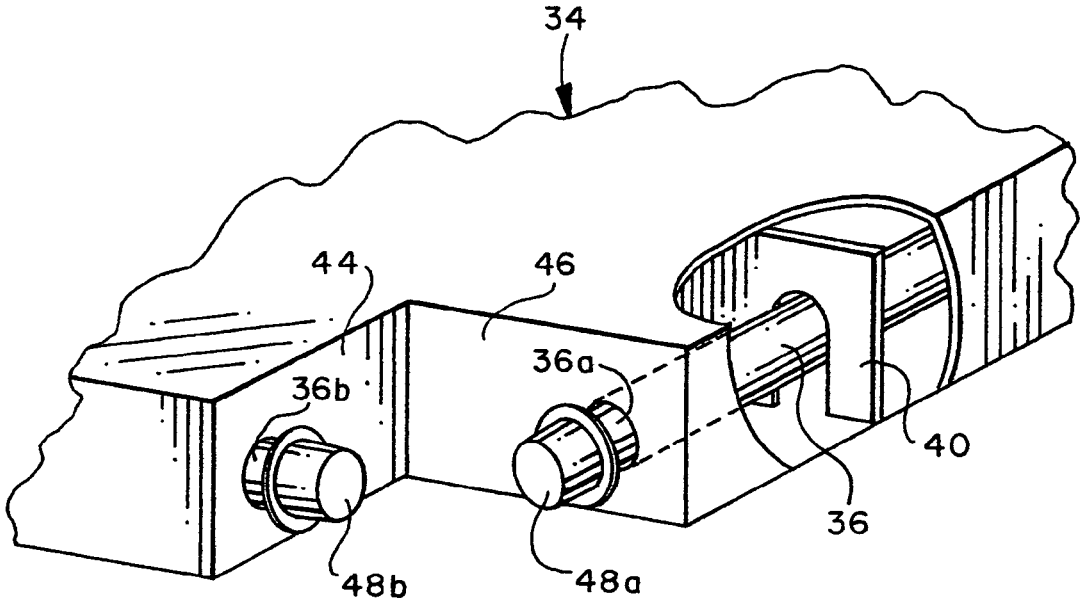
FIG. 7 is a detailed perspective view of a portion of the vibration dampening device of FIG. 3.

Referring also to FIG. 2, outdoor unit 12 includes a cabinet 22, which houses a second heat exchanger 24 and a compressor 26, which is operable to circulate a vapor compression refrigerant between the indoor and outdoor heat exchangers 14, 24 via a refrigerant conduit. The conduit is comprised of a first refrigerant line 28 communicating between first heat exchanger 14 and compressor 26, a second refrigerant line 30 communicating between compressor 26 and second heat exchanger 24 and a third refrigerant line 32 communicating between second heat exchanger 24 and first heat exchanger 14. Lines 28,30,32 are typically made of copper.

One skilled in the art will recognize that in a cooling mode, first heat exchanger 14 operates as an evaporator to cool supply air by transferring heat from the air flowing over the outside of heat exchanger 14 to the refrigerant flowing inside heat exchanger 14, which results in substantial evaporation of the refrigerant. Likewise, second heat exchanger 24 operates as a condenser to condense the evaporated refrigerant by rejecting heat from the refrigerant to outdoor air flowing over the outside of heat exchanger 24. In the cooling mode, first refrigerant line 28 functions as the suction line for compressor 26 and second refrigerant line 30 functions as discharge line for compressor 26. However, in the case of a heat pump system operating in a heating mode, the roles of heat exchangers 14,24 would be reversed. Indoor heat exchanger 14 would operate as a condenser to heat the supply air and outdoor heat exchanger 24 would operate as an evaporator. A reversing valve, not shown, would be located in line 28. In the heating mode, line 28 would function as the discharge line from compressor 26 to heat exchanger 14 and line 30 would function as the suction line from heat exchanger 24 to compressor 26.

As can be best seen in FIG. 1, the respective major portions of first and third refrigerant lines 28,32 are outside of cabinet 22, with only minor portions thereof being inside of cabinet 22, as shown in FIG. 2. When the air conditioning system is in operation, vapor refrigerant flows in line 28 and liquid refrigerant flows in line 32. Second refrigerant line 30 is entirely within cabinet 22, as shown in FIG. 2. Further, lines 28, 32 extend into building 11. The distance between indoor and outdoor units 10, 12 is typically on the order of 40 feet, so that the length of first and third refrigerant lines 28,32 is each about 40 feet. First refrigerant line 28 usually has a larger diameter than second and third refrigerant lines 30, 32 (e.g., ⅞ inch vs. ⅜ inch). As a result, first refrigerant line 28 is more rigid than second and third refrigerant lines 30,32, which makes first line 28 more prone to transmitting compressor-induced vibrations to structural components inside building 11 than second and third refrigerant lines 30,32. Further, line 28 is rigidly in contact with the outer housing of compressor 26 so that vibrations from operation of compressor 26 are transmitted directly through the compressor housing to refrigerant line 28.

As previously mentioned, such vibrations are typically associated with the vibration from the electric motor (not shown) that operates compressor 26. Such vibrations may be modulated by a low frequency (2 Hz or less) standing wave in first refrigerant line 28. The modulation produces a droning noise of varying intensity inside building 11 when the vibration of line 28 causes contact with walls or other structural components of building 11. This droning noise may be detected by occupants of building 11.

Referring also to FIGS. 3–7, the air conditioning system includes a device 33 for dampening compressor induced vibrations. Device 33 is comprised of a pad 34 positionable beneath cabinet 22 as a support member for outdoor unit 12 (as shown in FIGS. 1 and 2) and a refrigerant line section 36 housed in pad 34. One side of pad 34 is defined by a relatively flat major surface 38 on which outdoor unit 12 sits and an opposite side thereof is defined by an array of interconnecting ribs 40. Line section 36 defines a loop within pad 34. Portions of selected ribs 40 are removed to accommodate the passage of line section 36 therethrough, as can be best seen in FIGS. 5 and 7. Blocks of resilient material 42, such as a relatively rigid foam, are located in the spaces between selected ribs 40, as can be best seen in FIG. 5. Portions of line section 36 are embedded in resilient material 42, as can be best seen in FIG. 6. Resilient blocks 42 cushion line section 36 and hold it in place within pad 34. Resilient blocks 42 are preferably in contact with both line section 36 and pad 34 to provide a direct path for transmission of vibrations from line section 36 to pad 34. Support pad 34 is positionable in contact with the ground outside of building 11 to provide a direct vibration transmission path thereto. As can be best seen in FIG. 6, line section 36 includes an insulative wrap 43.

Refrigerant line section 36 is adapted to be interposed in refrigerant line 28 so that line section 36 forms a part of line 28, as shown in FIGS. 1 and 2, and the refrigerant flowing in line 28 is routed through pad 34. Line section 36 preferably has the same diameter as line 28 (e.g., ⅞ inch). One corner of pad 34 is notched to define right-angled surfaces 44, 46, as can be best seen in FIG. 7. Each surface 44, 46 has a cutout through which one end 36*a*, 36*b* of line section 36 emerges from pad 34. Ends 36*a*, 36*b* are adapted (e.g., by swaging) for attachment to line 28. One end 36*a*, 36*b* functions as the entry point for the refrigerant into pad 34 and the other end 36*a*, 36*b* functions as the exit point for the refrigerant out of pad 34, depending on how line 28 is connected to line section 36 and the direction of flow of the refrigerant in line 28. As can be best seen in FIG. 7, ends 36*a*, 36*b* may be protected by respective caps 48*a*, 48*b* to protect ends 36*a*, 36*b* when the vibration dampening device is not connected to line 28, such as during shipment or storage of the device.

For example, assume that end 36*a* is connected to the portion of line 28 between pad 34 and compressor 26 and that end 36*b* is connected to the portion of line 28 between pad 34 and indoor heat exchanger 14. In the cooling mode of operation of the air conditioning system, line 28 corresponds to the compressor suction line through which hot gaseous refrigerant from heat exchanger 14 flows to the suction side of compressor 26. The refrigerant flow would then be from heat exchanger 14 through line 28 into line section 36 through end 36*b*; through line section 36 and exiting therefrom through end 36*a* ; and back into line 28 to compressor 26. The length of line section 36 should be comparable to the wavelength of the standing wave to provide vibration dampening. For example, if the major dimensions of pad 34 are three feet by three feet, pad 34 can accommodate six to eight feet of line section 36, which should be sufficient length to significantly dampen the compressor vibrations.

Empirical testing has shown that routing the refrigerant flow through line section 36 in support pad 34 substantially reduces the vibrations from compressor 26 to the structural components of building 11 at frequencies of about 60 Hz and 120 Hz. It is believed that extra length of line 28 provided by line section 36, the frictional dampening of resilient blocks 42 and the transmission path to the ground from line section 36 through resilient blocks 42 and ribs 40 are all factors contributing to the dampening of compressor-induced vibrations in line 28. The vibration dampening device 33 described hereinabove may be included in the original installation of the air conditioning system or may be added as a retrofit component.

Figure 8:
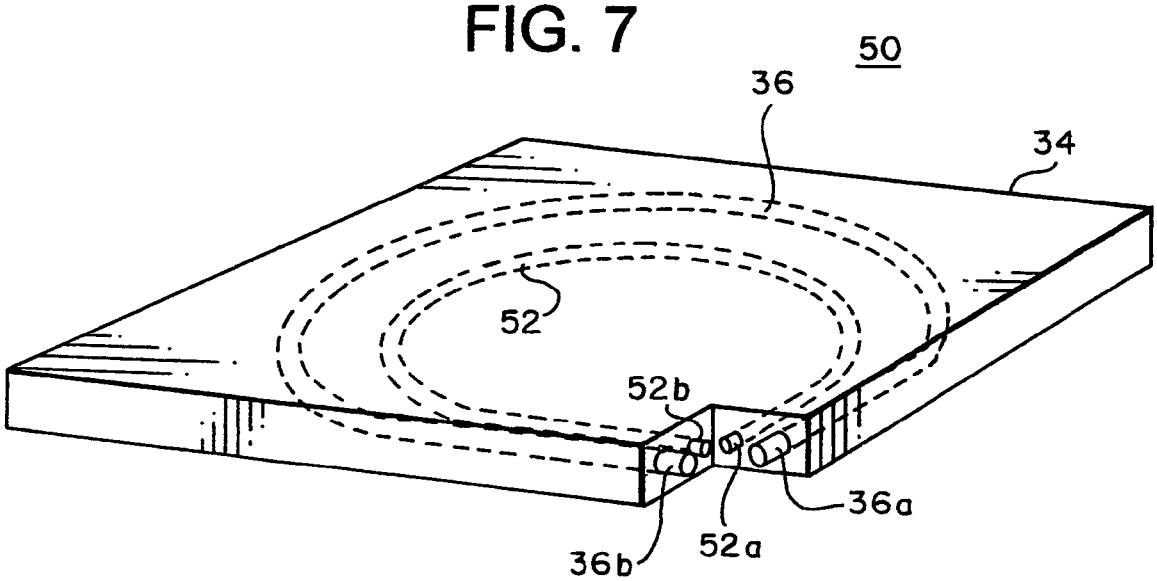
FIG. 8 is a perspective view of an alternate embodiment of a vibration dampening device, according to the present invention.

Referring to FIG. 8, an alternate embodiment of a vibration dampening device is shown. Device 50 is similar to device 33 described hereinabove with reference to FIGS. 1–7, except that device 50 includes a second line section 52 adapted to be interposed in liquid refrigerant line 32 in a manner similar to which line section 36 is adapted to be interposed in vapor refrigerant line 28, so that refrigerant flowing in line 32 is also routed through pad 34. Line section 52 preferably has the same diameter as line 32 (e.g., ⅜ inch). Further, line section 52 has two ends 52*a*, 52*b* protruding from pad 34 to facilitate connection of line section 52 to line 32. By providing pad 34 with the additional line section 52 adapted to be interposed in line 32, compressor induced vibrations in refrigerant line 32 may be dampened in a similar manner as described hereinabove with respect to refrigerant line 28.

The best mode for carrying out the invention has now been described in detail. Since changes in and modifications to the above-described best mode may be made without departing from the nature, spirit and scope of the invention, the invention is not to be limited to the above-described best mode, but only by the appended claims and their equivalents.

The invention claimed is:

1. In an air conditioning system having an indoor unit, an outdoor unit, a refrigerant conduit between said indoor unit and said outdoor unit, and a compressor operable to circulate refrigerant through said conduit between said indoor unit and said outdoor unit, wherein the improvement comprises a device for reducing compressor-induced vibration in said conduit, said device being comprised of a support member located beneath said outdoor unit and a section of refrigerant line housed in said support member, said section of refrigerant line being interposed in a portion of said refrigerant conduit between said compressor and said indoor unit, said compressor being external to said support member, said indoor unit having a first heat exchanger and said outdoor unit having a second heat exchanger, said refrigerant conduit including a first refrigerant line communicating between said first heat exchanger and said compressor, a second refrigerant line communicating between said compressor and said second heat exchanger and a third refrigerant line communicating between said second heat exchanger and said first heat exchanger, said compressor being operable to circulate refrigerant through said first, second and third refrigerant lines, said second heat exchanger being external to said support member, said section of refrigerant line being interposed in said first refrigerant line.

2. The system of claim 1 wherein one side of said support member is defined by a relatively flat surface for supporting said outdoor unit and an opposite side of said support member is defined by an array of interconnecting ribs.

3. The system of claim 1 wherein said section of refrigerant line defines a loop inside said support member, said loop having a length corresponding to a wavelength of a compressor-induced standing wave vibration in said portion of said refrigerant conduit.

4. The system of claim 1 wherein a resilient material is located within said support member between said section of refrigerant line and said support member.

5. The system of claim 4 wherein said support member includes an array of interconnecting ribs, said resilient material being located between said section of refrigerant line and said ribs and being in contact with both said section of refrigerant line and said ribs.

6. The system of claim 5 wherein said array of interconnecting ribs defines corresponding spaces between adjacent ribs, said resilient material being located in selected ones of said spaces.

7. The system of claim 1 wherein said portion of said conduit corresponds to a compressor suction line through which refrigerant is drawn from said indoor unit when said compressor is in operation.

8. The system of claim 1 wherein said support member is positioned between said outdoor unit and the ground outside of a building in which said indoor unit is located.

9. An air conditioning unit, comprising:

a refrigerant conduit;

a compressor for compressing a vapor compression refrigerant and circulating refrigerant through said conduit;

a heat exchanger;

a cabinet housing said compressor and said heat exchanger; and a device for reducing compressor-induced vibration in said conduit, said device including a support member housing a refrigerant line section, said support member being located beneath said cabinet and said refrigerant line section being in fluid communication with said refrigerant conduit, said compressor and said heat exchanger being external to said support member.

10. The unit of claim 9 wherein one side of said support member is defined by a relatively flat surface for supporting said cabinet and an opposite side of said support member is defined by an array of interconnecting ribs.

11. The unit of claim 9 wherein said refrigerant line section defines a loop inside said support member, said loop having a length corresponding to a wavelength of a compressor-induced standing wave vibration in said refrigerant conduit.

12. The unit of claim 9 wherein a resilient material is located within said support member between said refrigerant line section and said support member.

13. The unit of claim 12 wherein said support member includes an array of interconnecting ribs, said resilient material being located between said refrigerant line section and said ribs and being in contact with both said refrigerant line section and said ribs.

14. The unit of claim 13 wherein said array of interconnecting ribs defines corresponding spaces between adjacent ribs, said resilient material being located in selected ones of said spaces.

15. The unit of claim 9 wherein said refrigerant line section is interposed in a portion of said conduit corresponding to a compressor suction line through which refrigerant is drawn by said compressor into said unit when said compressor is in operation.

16. The unit of claim 9 wherein said unit is an outdoor unit of an air conditioning system, said support member being positioned between said cabinet and an outdoor surface.

17. The unit of claim 9 wherein the refrigerant conduit includes a first refrigerant line communicating with an inlet to the compressor and a second refrigerant line communicating between an outlet of the compressor and an inlet of said heat exchanger, said refrigerant line section defining a portion of said first refrigerant line.

18. A vibration dampening device for an air conditioning unit having a compressor for circulating a vapor compression refrigerant through a conduit, said device comprising:

a support member positionable beneath the unit;

a refrigerant line housed in said support member, said line being adapted to be interposed in the refrigerant conduit; and a resilient material located in said support member and being interposed between said refrigerant line and said support member to inhibit contact therebetween.

19. The device of claim 18 wherein one side of said support member is defined by a relatively flat surface for supporting said cabinet and an opposite side of said support member is defined by an array of interconnecting ribs.

20. The device of claim 18 wherein said refrigerant line defines a loop inside said support member, said loop having a length corresponding to a wavelength of a compressor-induced standing wave vibration in said conduit.

21. The device of claim 18 wherein said support member includes an array of interconnecting ribs, said refrigerant line extending through selected ones of said ribs, said resilient material being located between said refrigerant line and said selected ones of said ribs and being in contact with both said refrigerant line and said selected ones of said ribs.

22. The device of claim 21 wherein said array of interconnecting ribs defines corresponding spaces between adjacent ribs, said resilient material being located in selected ones of said spaces.

23. The device of claim 18 wherein said refrigerant line includes discrete first and second refrigerant line sections, each of said line sections being adapted to be interposed in a selected portion of the refrigerant conduit.

24. The device of claim 23 wherein said first and second refrigerant line sections define respective first and second loops inside said support member.

25. The device of claim 23 wherein said first refrigerant line section is adapted to be interposed in a first portion of the refrigerant conduit corresponding to a refrigerant suction line through which refrigerant is drawn into the unit when the compressor is in operation and said second refrigerant line section is adapted to be interposed in a second portion of the refrigerant conduit corresponding to a refrigerant discharge line through which refrigerant is discharged from the unit when the compressor is in operation.

* * * * *